US011499807B2

(12) United States Patent
Christensen

(10) Patent No.: US 11,499,807 B2
(45) Date of Patent: Nov. 15, 2022

(54) AUTONOMOUS WEAPON SYSTEM FOR GUIDANCE AND COMBAT ASSESSMENT

(71) Applicants: BAE SYSTEMS BOFORS AB, Karlskoga (SE); Jan Christensen, Karlskoga (SE)

(72) Inventor: Jan Christensen, Karlskoga (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 57 days.

(21) Appl. No.: 16/769,827

(22) PCT Filed: Dec. 17, 2018

(86) PCT No.: PCT/SE2018/051324

§ 371 (c)(1),
(2) Date: Jun. 4, 2020

(87) PCT Pub. No.: WO2019/132758

PCT Pub. Date: Jul. 4, 2019

(65) Prior Publication Data

US 2020/0393225 A1 Dec. 17, 2020

(30) Foreign Application Priority Data

Dec. 28, 2017 (SE) ..... 1700313-8

(51) Int. Cl.

| | |
|---|---|
| ***F42B 10/56*** | (2006.01) |
| ***F42B 12/36*** | (2006.01) |
| *F41G 7/30* | (2006.01) |
| *F41G 9/00* | (2006.01) |
| *F42B 12/58* | (2006.01) |

(52) U.S. Cl.
CPC ..... *F42B 10/56* (2013.01); *F42B 12/365* (2013.01); *F41G 7/303* (2013.01); *F41G 7/308* (2013.01); *F41G 9/002* (2013.01); *F42B 12/58* (2013.01)

(58) Field of Classification Search
CPC ..... F42B 10/56; F42B 12/365; F42B 12/58; F41G 7/303; F41G 7/308; F41G 9/002
See application file for complete search history.

(56) References Cited

U.S. PATENT DOCUMENTS 4,553,718 A 11/1985 Pinson
4,860,968 A * 8/1989 Pinson ..... F41G 7/32 244/3.12

(Continued)

FOREIGN PATENT DOCUMENTS

EP 1612504 A1 1/2006

OTHER PUBLICATIONS

International Search Report (dated Mar. 14, 2019) for corresponding International App. PCT/SE2018/051324.

*Primary Examiner* — Joshua E Freeman
(74) *Attorney, Agent, or Firm* — WRB-IP LLP

(57) ABSTRACT

An autonomous weapon system for improved guidance of a projectile for homing a target includes a guided projectile including at least one sensor and a carrier projectile and at least one guidance and reconnaissance unit including a transmitter for communication via light. The system uses emitted light for both positioning and communication of target coordinates which provides an accurate and cost effective system for combatting point and surface targets by indirect fire.

7 Claims, 4 Drawing Sheets

(56) References Cited

U.S. PATENT DOCUMENTS

| | | | | |
|---|---|---|---|---|
| 5,467,681 | A * | 11/1995 | Liberman | F42B 10/56 244/3.1 |
| 5,983,161 | A * | 11/1999 | Lemelson | G07C 5/0891 701/301 |
| 6,279,482 | B1 * | 8/2001 | Smith | F42B 12/60 102/357 |
| 6,380,889 | B1 * | 4/2002 | Herrmann | G01S 19/18 340/870.1 |
| 6,510,776 | B2 * | 1/2003 | Sirmalis | F41G 3/142 244/3.12 |
| 7,373,849 | B2 * | 5/2008 | Lloyd | F42B 12/365 73/865.8 |
| 9,157,717 | B1 | 10/2015 | Carroll et al. | |
| 9,234,728 | B2 * | 1/2016 | Akcasu | B64D 17/00 |
| 9,823,070 | B2 * | 11/2017 | Stephens, Jr. | H04N 5/23203 |
| 2003/0016348 | A1 * | 1/2003 | Sallee | F41G 7/2293 356/141.1 |
| 2006/0010998 | A1 * | 1/2006 | Lloyd | F42B 12/365 73/866.5 |
| 2008/0006735 | A1 | 1/2008 | Fein et al. | |
| 2008/0308670 | A1 * | 12/2008 | Meyer | F41G 7/2206 244/3.1 |
| 2010/0057285 | A1 | 3/2010 | Murphy et al. | |
| 2010/0192439 | A1 * | 8/2010 | Murello | F41A 25/10 42/1.06 |
| 2011/0185935 | A1 * | 8/2011 | Jennings | G01S 7/4818 102/213 |
| 2012/0001015 | A1 | 1/2012 | Brosch et al. | |
| 2013/0001354 | A1 | 1/2013 | Meyer et al. | |
| 2013/0336662 | A1 * | 12/2013 | Murayama | H04B 10/116 398/130 |
| 2018/0312069 | A1 * | 11/2018 | McClymond | B60L 53/67 |

* cited by examiner a)

AUTONOMOUS WEAPON SYSTEM FOR GUIDANCE AND COMBAT ASSESSMENT

BACKGROUND AND SUMMARY

The present invention relates to guided-projectile-based weapon systems, more particularly to a weapon system comprising a guided projectile and a separate guidance and reconnaissance unit for controlling guided projectiles toward a target.

Modern ammunition for indirect combat military targets has been provided with different technologies to improve precision and hit probability in order to increase the combat effectiveness and at the same time reduce eventual unnecessary and undesirable damage in the surroundings, i.e., collateral damage (CLD).

To improve the hit incident projectiles are for example provided with embedded control and navigation systems for correction of negative influences that can occur before and/or during the flight towards a target. The ballistic flight path can then be updated and corrected with new target data via modern communication links.

A high measurement accuracy of critical parameters, such as for example temperature, wind and exact positioning of all ingoing nodes, is required to achieve high precision and hit probability. Existing guided projectiles are preferably programmed with target coordinates before or after launch of the projectile. Positioning of the projectile is determined with for example a gyro (inertial navigation system), or using satellites e.g., GPS (e.g., Excalibur), light can also be used to position and identify a target, for example UV, IR, and laser (e.g., Krasnopol). Laser pointers can be used to label a target physically as the projectile moves, as well as infrared imaging light (IR) are used and can correct the projectile coordinates in the end phase if needed (e.g., STRIX).

U.S. Pat. No. 9,157,717 discloses a projectile system utilising swarm technology, the system comprises at least one first ballistic device having a payload configured to detonate and a second ballistic device configured to track a position and movement of an object. A targeting module illuminates an object with an ultraviolet, visible, or near infrared light, and the first ballistic device detects the light and is launched and/or projected towards the light. Additionally or alternatively—the target information is transmitted to the first ballistic device that is launched and/or projected towards the object using boost package in accordance with the target information.

U.S. Pat. No. 5,467,681 discloses a way to position an unmanned reconnaissance payload over a potential target area, using a cargo projectile launched from a conventional tubed artillery piece. The ejected reconnaissance payload is connected via a tow line to the ballistic cargo projectile, allowing the payload with its parafoil to achieve a greater height, enter an orbit, and extend a longer time over the target area. The surveillance payload may be exchanged to "smart" munition.

US 2013/0001354 A1 discloses a sensor system that uses ground emitters to illuminate a projectile in flight with a polarized RF beam.

US 2008/0006735 discloses a weapon system comprising a guided missile with a distributed guidance mechanism. The guided missile includes a seeker for producing signals indicative of a position of a target, and a steering mechanism for steering the guided missile. The guidance mechanism controls the steering mechanism, based on the signals, so as to steer the guided missile towards the target. Analyse is made by audio and/or image processing. The guidance mechanism can also perform damage assessment and the system may communicate wireless (RF), optical signals via optic fibre or electrical signals via electrically conductive wires, analogue or digital.

In order to navigate via satellites, the projectile requires reception antennas, which themselves are susceptible to interference from hostile radio transmitters.

A further disadvantage of GPS and control inertial navigation systems is that the systems do not assist a projectile to find its goal, only improve the ability to meet the geographic point that the system is preprogrammed to meet.

The number of projectiles and dispersion distribution to combat a target is based on probability calculations of known information (imaging methods). An embedded imaging sensor system (optronics) is required if the projectile itself would find its target and correct its final path. The correction of the final path of the projectile is based on statistical data of known information (reference library), models of approved targets and/or terrain descriptions with designated target positions, which means that the predetermined coordinates may not always reflect the correct coordinates of the target in the real-time situation. Moreover, such a system must withstand the strains when the projectile is launched. Thus, such systems require high quality and are therefore quite expensive.

An alternative is to provide the projectile with a laser sensor as described above. However, these projectiles have both tactical and technical drawbacks and are dependent on constant illumination of a target, commonly performed by a soldier close to the target with considerable risk. The laser beam must be in range for the projectile, and it is also a security risk if the system incorrectly interprets the position of the soldier as target. The systems also require quite strong and expensive laser transmitters. Atmospheric disturbances, such as for example fog and snow, influence the performance negatively, and the material properties can create defects in the optical reflection thereby also influence the performance negatively.

Guided projectiles comprising guiding mechanisms suffer from drawbacks including high cost and high weight of the guidance computer that also requires high power requirement that must be satisfied by a bulky and expensive power supply, The use of up-dating algorithms to control guided projectiles often entails a more powerful guidance computer, which replacement must be done for every guided projectile separately. The guidance computer will also be destroyed along with the rest of the guided projectile when it strikes the target.

Moreover, it is also not always possible to confirm that the target has been combated, as it is difficult to confirm a successful mission due to, for example, distance, obstacles, security issues etc. or the soldier could also be incapacitated.

In view of the above information there is a need for an autonomous weapon system that can assist a projectile or projectiles to find their target or targets in real-time and cost effectively combat point or surface targets in a qualified interference environment, thereby increasing the hit rate, and at the same time minimize the incident of collateral damage and cost.

It is desirable to provide an autonomous weapon system for improved guidance of a projectile or projectiles for homing a target.

It is desirable to provide an autonomous weapon system for combatting a target; the system comprises a guided projectile carrying a payload, (warhead) and a carrier projectile carrying a guidance and reconnaissance unit.

According to an aspect of the invention, an autonomous weapon system comprises:

a) a guided projectile comprising at least one sensor; and b) a carrier projectile; and c) at least one guidance and reconnaissance unit, comprising:

- a first sensor for detection and identification of a target and/or point of impact;
- a second sensor for determining position and/or attitude;
- a computer for calculating position and/or vectors and/or predictions;
- a programmable digital reference library for target and/or terrain models;
- a control system for loitering and/or reduced falling velocity; and
- a transmitter for wireless communication.

The guided projectile is any guided projectile comprising a payload and compatible with the described system. The guided projectile of the weapon system is for example a mortar or artillery shell. The weapon system can also comprise a plurality of guided projectiles.

The carrier projectile is also any carrier projectile or shell suitable for carrying at least one guidance and reconnaissance unit. The carrier projectile comprises a fuse, a separation charge and a space or chamber for carrying at least one guidance and reconnaissance unit.

The transmitter can for example communicate via light, preferably visible light.

The at least one sensor of the guided projectile according to 1*a*, is in one embodiment an optical sensor.

In one embodiment the communication of the weapon system is wireless radio communication, for example Wi-Fi or Li-Fi. The communication is preferably digital communication via visible light, i.e., Li-Fi.

It is desirable to provide a guidance and reconnaissance unit. The guidance and reconnaissance unit may be carried and transported by a carrier shell. A carrier shell or projectile may comprise at least one guidance and reconnaissance unit.

The at least one guidance and reconnaissance unit described above comprises:

- a first sensor for detection and/or identification of a target and/or point of impact;
- a second sensor for determining position and/or attitude;
- a computer for calculating position and/or vectors and/or predictions;
- a programmable digital reference library for target and/or terrain models;
- a control system for control function of loitering and/or reduced falling velocity; and
- a transmitter for communication.

The transmitter for communication communicates in one embodiment via light, preferably visible light.

The guidance and reconnaissance unit or units may also in one embodiment be arranged to a parachute.

The first sensor of the guidance and reconnaissance unit is a sensor for detection, and/or identification and/or hit point of a target is in one embodiment an imaging and/or visual and/or thermal wavelength wave sensor, such as for example UV/VIS/TIR. In one embodiment the number of the first sensor is at least one. In other embodiments the guidance and reconnaissance unit have a plurality of first sensors. The sensors may have any combination of the properties described in the present application.

The at least one second sensor of the guidance and reconnaissance unit for measuring position and/or attitude is in one embodiment an angle sensor and/or an altimeter and/or a distance gauge. In one embodiment the number of the second sensor is at least one. In other embodiments the guidance and reconnaissance unit has a plurality of second sensors. The sensors may have any combination of the properties described in the present application.

The processing of the computer includes image processing and/or signal processing.

The guidance and reconnaissance unit is in one embodiment operative to provide combat assessment. The combat assessment is in one embodiment performed via an UV-sensor.

In another embodiment the guidance and reconnaissance unit described above further comprises a chemical illuminating device.

In yet another embodiment the guidance and reconnaissance unit further comprises a transmitter for radio communication with a C3I-system.

In yet another embodiment the guidance and reconnaissance unit further comprises an auto-destructive and/or an information auto-deletion mechanism.

It is desirable to provide a process for guiding a projectile for homing a target by using the autonomous weapon system described above.

According to an aspect of the invention, a process for guiding a projectile for homing a target by using the autonomous weapon system as defined above comprises the steps of:

identifying an area and/or a target of interest;

launching a pre-programmed carrier projectile comprising at least one guidance and reconnaissance unit, from a cannon, gun or mortar towards a predetermined area of interest;

launching at least one pre-programmed projectile comprising payload from a cannon, gun or mortar towards the predetermined area and/or target; separating the at least one guidance and reconnaissance unit from the carrier projectile in the region of interest by induction of a separation charge, whereby the guidance and reconnaissance unit is released, activated and loiter down over the predetermined region and/or target for detecting and/or identifying the pre-programmed target from a reference library; calculating the vectors to the target; transforming the vectors to one or more target position coordinates; encrypting and packaging the target position coordinates; communicating the data package obtained in the former step via a transmitter in one or several given angular regions to the at least one guided projectile that relatively independent of the approach angle detects the light signal from the guidance and reconnaissance unit and receives the encrypted data package comprising the target vector with which the projectile corrects its ballistic path for hitting the target with high precision.

The transmitter may be a light transmitter.

The process may also operate to provide combat assessment, preferably via an UV-sensor.

In summary, the present invention provides a system wherein a guidance and reconnaissance unit identifies a target or targets, safely communicates the real-time position of the target or targets to a guided projectile or projectiles carrying payload and flying towards the target. The guidance and reconnaissance unit also enables combat assessment i.e., evaluates whether the effort succeeded or if a new fire effort is required. The system is autonomous, not dependent on a third party for operations or observations, i.e., a soldier or any person.

BRIEF DESCRIPTION OF DRAWINGS

The invention is now described, by way of example, with reference to the accompanying drawings, in which.

DETAILED DESCRIPTION

Figure 1:
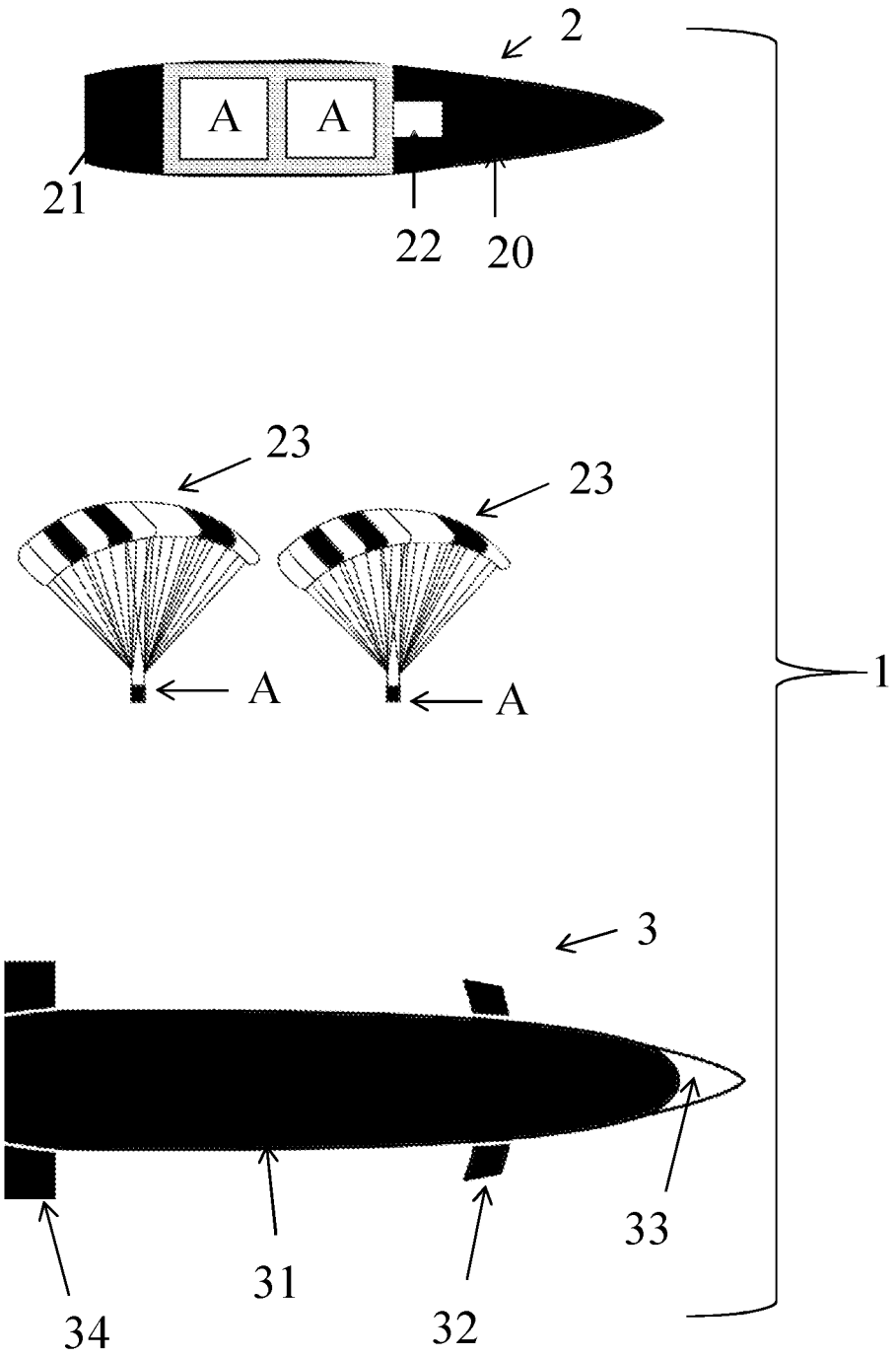
FIG. 1 shows a system comprising a guided projectile carrying a payload and a carrier projectile comprising at least one guidance and reconnaissance unit for providing a guidance mechanism.

Before the invention is disclosed and described in detail, it is to be understood that this invention is not limited to particular materials or configurations disclosed herein as such configurations and materials may vary. It is also to be understood that the terminology employed herein is used for the purpose of describing particular embodiments only and is not intended to be limiting, since the scope of the present invention is limited only by the appended claims.

In context of the present invention the term payload means the load carried by a projectile exclusive of what is necessary for its operation. The payload may for example be a guidance and reconnaissance unit or system, warhead, munition, sub-munition, illuminating modules, a light transmitter, a radio communication transmitter, an auto-destruction module, etc.

In context of the present invention the term guided projectile means a projectile intended to precisely hit a specific target, to minimize collateral damage and increase lethality against intended targets.

In context of the present invention the term artillery means guns, cannon, howitzers, mortars, etc. of calibre greater than 20 mm.

In context of the present invention the term fuse means a device that initiates an explosive function in a munition, carrier shell, most commonly causing it to detonate or release its contents, when its activation conditions are met.

In context of the present invention the term target means any subject of interest, for example a ship, a vehicle, a plane, a building, a moat, a company or military unit, a war zone or any region or subject of interest.

In context of the present invention the term autonomous system (AS) means a network or a collection of networks that are all managed and supervised by a single entity or organization, preferably a guidance and reconnaissance unit as described below.

In context of the present invention the term sensor is a device, module, or subsystem whose purpose is to detect and register events or changes in its environment and send the information to other electronics, frequently a computer processor. A sensor is always used with other electronics, whether as simple as a light or as complex as a computer.

When combatting a plurality of qualified targets within a specified area, for example to stop a military unit to advance over an area (area denial) or force them to take another way, technical, logistical and time-critical problems arise. The number of available projectiles having capability to combat the qualified targets is often limited due to unit costs, why target prioritization must be made. Technical and tactical problems can also occur when combatting a time critical point target where the target is likely to change position, its protection characteristics or increased risk of collateral damage after the fire opening and the projectiles are heading towards the target. Most existing solutions are cost-driven and usually increases the manufacturing cost with the requirement of increased accuracy. The weapon system described below provides a cost effective and accurate weapon system solving many problems of prior art.

The present invention will now be described in detail with reference to the accompanying figures, in which a general embodiment of the invention is shown.

Figure 4:
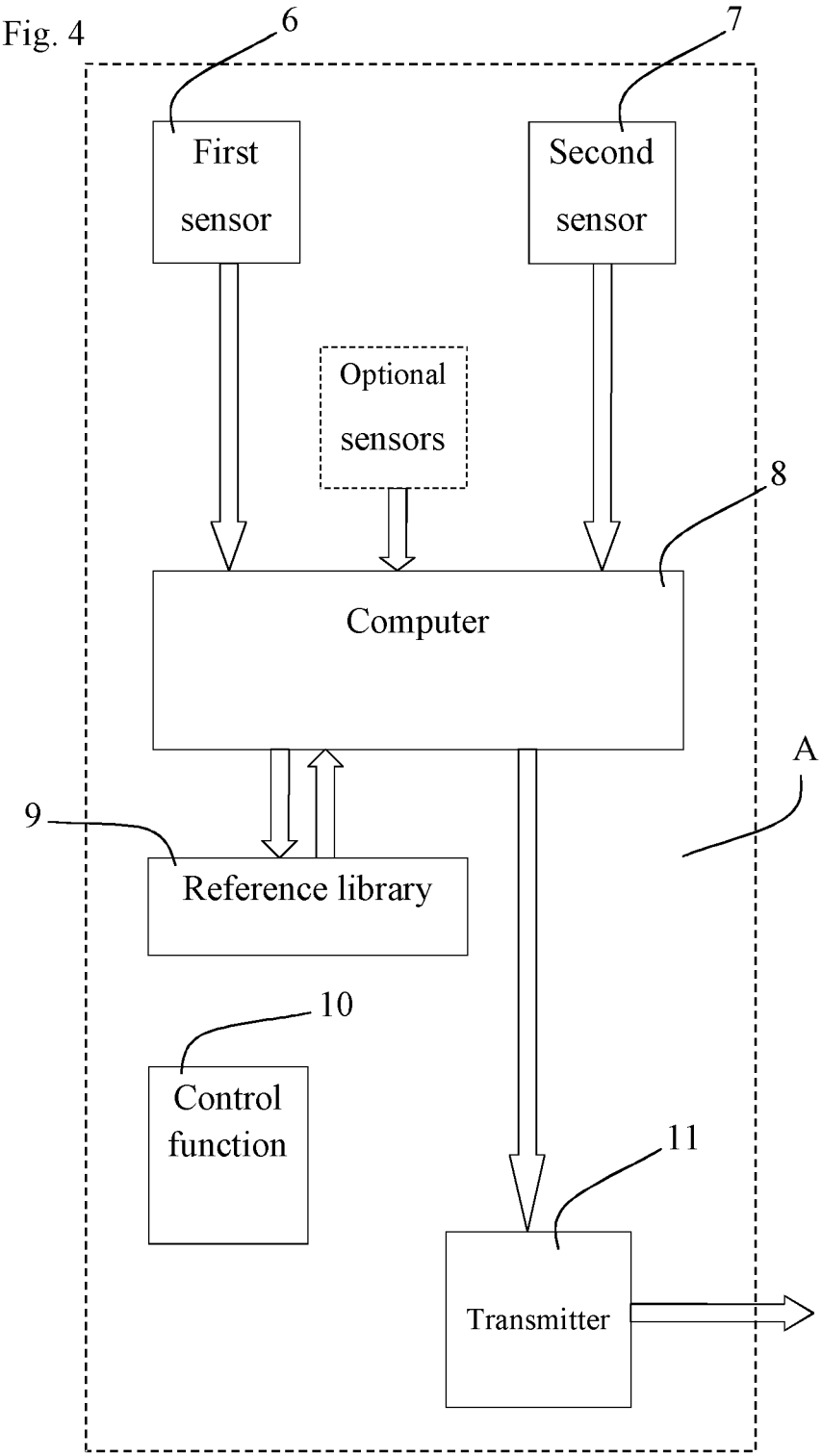
FIG. 4 shows components of the guidance and reconnaissance unit.

FIG. 1 shows a system for improving the guidance of at least one projectile 3 to combat a predetermined target 4. The system 1 comprises a carrier projectile 2 for transporting a guidance and reconnaissance unit A to an area of interest, and a guided projectile 3 comprising a payload/warhead 31. The carrier projectile 2 comprises a front projectile body and a fuse 20, a rear projectile body 21, a separation charge 22 arranged in the nose part 20 and a payload chamber 23 arranged in the front projectile body 20. The payload chamber 23 comprises at least one guidance and reconnaissance unit A. The at least one guidance and reconnaissance unit A can in one embodiment be arranged to a parafoil or a parachute 24 which develops upon release from the carrier projectile 2. The guidance and reconnaissance unit A further comprises a first sensor 6 for detection and identification of a target and/or impact point, a second sensor 7 for determining the position or attitude, a computer 8 and a programmable and digital reference library 9, a system for control function 10 and loitering and/or reduced fall velocity, and a transmitter 11 for wireless communication. The components of the guidance and reconnaissance unit are illustrated in FIG. 4.

The fuse may for example be a time fuse or a proximity fuse.

The first sensor 6 for detection and identification of a hit point i.e., a target 4 can for example be an imaging, visual and/or thermal wavelength wave sensor (UV/VIS/TIR). The first sensor 6 is not limited to be one, it is at least one, and several sensors with identical or separate function are possible.

The second sensor 7 for measuring position and attitude is for example an angle sensor, altimeter and/or a distance gauge. The second sensor 7 is not limited to be one, it is at least one, and several sensors with identical or separate function are possible.

The guidance and reconnaissance unit A may further comprise a loitering sensor.

The guidance and reconnaissance unit A may further comprise a UV-sensor for hit assessment.

The computer 8 is a calculation device comprising a microprocessor, microcontroller, DSP or other digital electronics configured to perform processing of digital information. The processing comprises for example calculation of position, vectors, and predictions based on input data. The processing includes image processing and signal processing.

The programmable and digital reference library 9 contains for example target and/or terrain models.

The guidance and reconnaissance unit A may also comprises a control function 10 and loitering and/or reduced fall velocity.

The transmitter 11 communicates preferably wireless via light, preferably visible light.

The communication is wireless, for example via Wi-Fi or Li-Fi.

The carrier projectile 2 can comprise for example two identical guidance and reconnaissance units or units that comprise different functions of the ones described above. If at least two guidance and reconnaissance units are involved in the system, those can communicate with each other and thereby provide more accurate data for guiding the projectiles 2 towards its target 4. In other embodiments the guidance and reconnaissance units A are identical and do not communicate with each other, only with the corresponding projectiles 3. As mentioned, the guidance and reconnaissance unit A is at least one, but the use of several guidance and reconnaissance units is preferable.

The at least one guidance and reconnaissance unit A guides at least one projectile 3, but guiding several projectiles 3 is also an alternative.

The system can also comprise additional complementary systems such as for example a chemical illuminating device for lighting up the terrain, positioning and facilitate communication during night or bad weather; transmitter for radio communication using C3I system; and a function for auto destruction or auto erasing data. The additional systems may be used alone or in combination with the existing ones.

The guided projectile 3 may be any projectile suitable for indirect combatting a target 4 as described above for example artillery or mortar shell, well known by the skilled person and will not be further described here. The guided projectile 3 comprises a payload chamber 31 comprising a payload, a sensor 33, and fins 32, 34. The sensor 33 receives digital communication signals. The fins 34 and/or 32 constitute the steering mechanism. The payload is of any standard type for artillery and mortar shells. The sensor 33 is preferably an optical sensor, for example an optical receiver and/or transmitter.

Other embodiments may have a plurality of sensors, for example to provide flight position data by detecting the relative orientation of the projectile body 3 during operation. The output of the sensors is fed into a guidance control system to enable flight corrections when necessary. The guidance control system may be any system suitable for guiding spin stabilized projectiles during flight.

The at least one guidance and reconnaissance unit A, may be attached to a parafoil or parachute 23 that develops when the guidance and reconnaissance unit A, is released from the carrier projectile 2.

The carrier projectile 2 comprising the at least one guidance and reconnaissance unit A, can be any suitable carrier projectile or shell well known by the skilled person and will not be further described here. The carrier projectile 2 can be launched before, simultaneously or after the projectile or projectiles 3.

The carrier projectile 2 comprising the at least one guidance and reconnaissance unit A, and the projectile 3 can be launched from the same location or from different launching locations/platforms.

Figure 2:
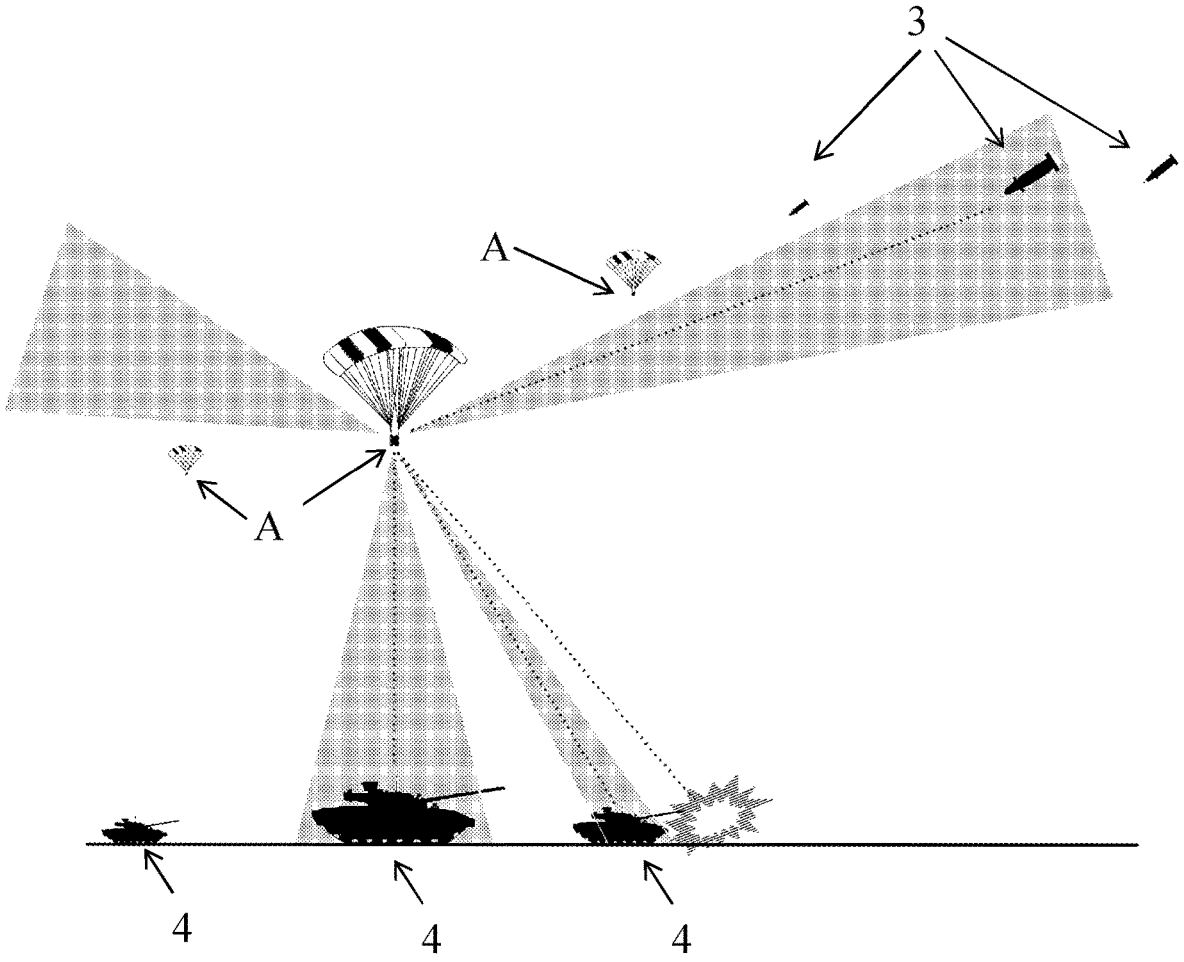
FIG. 2 shows an illustration of the guidance and reconnaissance unit and communication process for combatting a target.

FIG. 2 illustrates a procedure for combatting a target 4 by using the autonomous weapon system 1 of the present invention. The process comprises the steps of:

identifying an area and/or a target 4 of interest;

launching the pre-programmed carrier projectile 2 comprising the at least one guidance and reconnaissance unit A, from a cannon, gun or mortar towards a predetermined area of interest;

launching the at least one pre-programmed projectile 3 comprising payload from a cannon or mortar towards the predetermined area and/or target 4;

separating the at least one guidance and reconnaissance unit A from the carrier projectile 2 in the region of interest 4 by induction of the separation charge 22, whereby the guidance and reconnaissance unit A is released, activated and slowly loiter down over the predetermined region and/or target 4 for detecting and identifying the pre-programmed target 4 from a reference library 9;

calculating vectors to the target 4;

transforming the vectors to one or more target position coordinates;

encrypting and packaging the target position coordinates;

communicating the data package obtained in the former step via a light transmitter in one or several given angular regions to the at least one guided projectile 3 that relatively independent of the approach angle detects the light signal from the guidance and reconnaissance unit A and receives the encrypted data package comprising the target vector with which the projectile 3 corrects its ballistic path for hitting the target 4 with high precision.

The embedded calculation computer 8 calculates the vectors to the target and converts those to one or several target coordinates by using for example an angle sensor, altimeter or a distance gauge. The data is encrypted and the data package is sent via a light emitter.

The target position 4 is calculated for example via triangulation.

The light emitter can for example be an adapted LED-light with associated optronics, or for example an illuminating device with a technical construction enabling the light to be transformed into coded light pulses. The primary use of the illuminating device is to lighten the battle field and secondary to improve the performance of the other integrated sensors in dark or dim view.

The light emitter may be a part of the reconnaissance system, or an additional feature to the guidance and reconnaissance unit A.

The guidance and reconnaissance unit A can detect UV-light generated from the detonation of the guided projectile 3 and calculates the deviation from the defined target coordinates and the actual hit point. If the deviation is too large continues the light signalling of the target vector with eventual corrections for the targets new position thereby enables another guided projectile 3 to steer towards the target 4.

In one embodiment the guidance and reconnaissance unit A can send a compilation to a connected management system via a radio signals (RF). The compilation (C3I) comprises for example total identified targets 4, type of targets and how many that were hit before the guidance and reconnaissance unit 2 reached the ground or was deactivated, see FIG. 3.

The information is preferably communicated via for example wireless fidelity (Wi-Fi) and/or light fidelity (Li-Fi).

Communication based on emitted light emitted in a given angle range makes it difficult for hostile interception or hostile tampering. The light signal is also difficult to detect from the ground. The light communication can also be sent in a relatively restricted wavelength range and with a low out effect in order to further decrease its signature that can be detected by hostile detectors.

Moreover, target identification is not dependent on the approach angle for the guided projectile comprising payload 3.

The guidance and reconnaissance unit A, can communicate with the at least one projectile 3, and/or the at least one base station. The guidance and reconnaissance unit A, can also communicate with another system. The information communicated is safe for hostile interception or hostile tampering. Draw backs by using Wi-Fi is that it can have interference issues from nearby access points (routers), and it cannot pass through sea water, and works in less dense region. Li-Fi do not have any interference issues similar to radio frequency waves, and can pass through salty sea water, and works in dense regions. A combination of Wi-Fi and Li-Fi can also be used for safe communication.

Swarm intelligence (SI) or similar technologies could also be used or combined with the present system 1.

For example can a carrier projectile 2 be launched from one location, separate the guidance and reconnaissance unit A, at a predetermined position, retrieve data from the surroundings and target communicate the real-time data to a base station and/or a launched projectile 3 or that a projectile 3 shall be launched to a specific position. For example two or more projectiles 3 can be launched from different locations towards a target 4, this strategy increases the possibility that the target 4 cannot counteract projectiles 3 flying towards the target from different directions. In yet another embodiment the projectiles 3 are launched from different places and time points.

Figure 3:
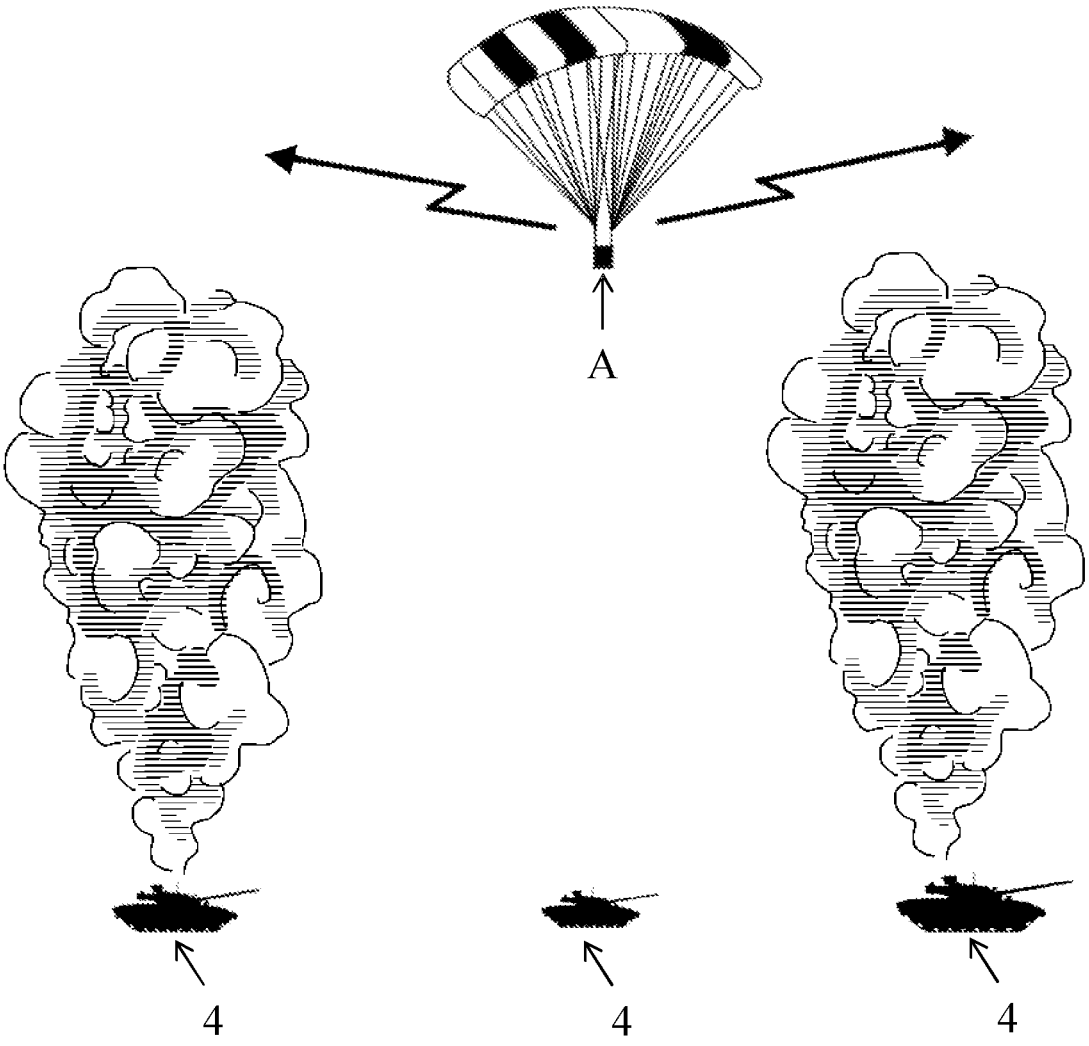
FIG. 3 shows an illustration of a combat assessment situation.

The system 1 further enables combat assessment, and can also coordinate a new attack if necessary as illustrated in FIG. 3.

The at least one guidance and reconnaissance unit A, detects whether the at least one guided projectile 3 succeeded to hit the target 4 or not, i.e. combat assessment. UV light generated from the detonation of the guided projectile (3) is detected by the guidance and reconnaissance unit A that calculates the deviation from the defined target coordinates and actual hit point. If the deviation is within the stated tolerance values, the illumination of the target coordinates is interrupted. If the first attack did not succeed, the guidance and reconnaissance unit A, continues to light signal the coordinates of the target 4 to a second projectile 3 that attacks the target 4 or a new target. In another embodiment, a firefighter controls the outcome of the attack.

The at least one guidance and reconnaissance unit A, can also control a plurality of guided projectiles 3.

If there is more than one guidance and reconnaissance unit A, these can communicate with each other and thereby obtain more accurate coordinates to the target. Or, they can be pre-programmed to control different parameters or separate guided projectiles 3.

In summary, the present invention provides an autonomous weapon system for combatting point and surface targets. The system is not dependent on GPS or expensive inertial navigation systems; emitted light is used for both positioning and communication of target coordinates which provides a cost effective system for combatting point and surface targets by indirect fire.

The invention claimed is:

1. A carrier projectile comprising a guidance and reconnaissance unit, the carrier projectile being launchable from a cannon, gun or mortar towards a predetermined area of interest in combination with a guided projectile comprising a payload, the guided projectile being launchable from a cannon, gun or mortar towards an area and/or target, the guidance and reconnaissance unit comprising a computer, a programmable digital reference library containing target and/or terrain models for detecting and identifying the area and/or target, and a transmitter for communication with the guided projectile via light wherein the guidance and reconnaissance unit is separable from the carrier projectile in the predetermined area of interest by inducing a separation charge such that the guidance and reconnaissance unit is released, is activated, and loiters down over the predetermined area of interest and is adapted to detect and identify a pre-programmed area and/or target from the reference library, the guidance and reconnaissance unit including a control system configured to control loitering and or falling velocity of the guidance and reconnaissance unit:

the computer being configured to calculate vectors to a target of the area and/or target, transform the vectors to one or more target position coordinates, and encrypt and package the target position coordinates to produce an encrypted data package;

the transmitter being configured to communicate the encrypted data package in one or several given angular regions to the at least one guided projectile;

the guided projectile being configured to detect a signal from the guidance and reconnaissance unit, receive the encrypted data package, and correct a ballistic path of the guided projectile toward the target in response to the signal from the guidance and reconnaissance unit and the detected encrypted data package.

2. The carrier projectile and guided projectile combination according to claim 1, wherein the transmitter for communication communicates via visible light.

3. The carrier projectile and guided projectile combination according to claim 1, comprising a parachute.

4. The carrier projectile and guided projectile combination according to claim 1, wherein the first sensor is an imaging and/or visual and/or thermal wavelength wave sensor.

5. The carrier projectile and guided projectile combination according to claim 1, wherein the second sensor is an angle sensor, and/or altimeter and/or a distance gauge.

6. The carrier projectile and guided projectile combination according to claim 1, wherein the guidance and reconnaissance unit is operative to provide combat assessment.

7. A process for guiding a projectile for homing a target by using a guidance and reconnaissance unit, comprising:

identifying an area and/or a target of interest;

launching a pre-programmed carrier projectile comprising at least one guidance and reconnaissance unit, from a cannon, gun or mortar towards a predetermined area of interest;

launching at least one pre-programmed projectile comprising a payload from a cannon, gun or mortar towards the area and/or target;

separating the at least one guidance and reconnaissance unit from the carrier projectile in the predetermined area of interest by inducing a separation charge, whereby the guidance and reconnaissance unit is released, is activated, and loiters down over the predetermined area of interest for detecting and identifying a pre-programmed target from a reference library;

calculating vectors to a target of the area and/or target;

transforming the vectors to one or more target position coordinates;

encrypting and packaging the target position coordinates to produce an encrypted data package;

communicating the encrypted data package via a transmitter in one or several given angular regions to the at least one guided projectile;

detecting, with the at least one guided projectile, a signal from the guidance and reconnaissance unit;

receiving, with the at least one guided projectile, the encrypted data package; and correcting a ballistic path of the at least one guided projectile toward the target in response to the signal from the guidance and reconnaissance unit and the detected encrypted data package.

* * * * *